United States Patent [19]

Tuncel et al.

[11] Patent Number: 4,747,360

[45] Date of Patent: May 31, 1988

[54] CONDENSER INTEGRATED TURBINE SUPPORT

[75] Inventors: Ozcan Tuncel, Lynnfield; Sammuel Mushnick, Sudbury, both of Mass.

[73] Assignee: General Electric Company, Schenectady, N.Y.

[21] Appl. No.: 507,359

[22] Filed: Jun. 24, 1983

[51] Int. Cl.[4] ..... B63H 21/06

[52] U.S. Cl. ..... 114/269; 60/690; 60/692; 248/638; 440/111

[58] Field of Search ..... 440/111 X; 114/269; 248/637-639; 165/47, 67, 68, 82; 60/690, 692

[56] References Cited

U.S. PATENT DOCUMENTS

| | | | |
|---|---|---|---|
| 1,066,209 | 7/1913 | Ljungström | 248/638 |
| 2,531,178 | 11/1950 | Van Nest | 60/95 |
| 3,719,045 | 3/1973 | Hoffman | 60/690 |

FOREIGN PATENT DOCUMENTS

| | | | |
|---|---|---|---|
| 458257 | 7/1949 | Canada | 60/692 |
| 651246 | 3/1951 | United Kingdom | 60/690 |

*Primary Examiner*—Sherman D. Basinger
*Attorney, Agent, or Firm*—Jerome C. Squillaro

[57] ABSTRACT

A support system for a marine turbine power plant may include an integral condenser. The support system comprised of plate girders and welded plate steel cover may envelop the condenser within the structure in order to save weight in the ship's payload. Certain modifications have to be made to adapt the support to include an integral condenser including the ability of the base to accommodate thermal expansion, noise isolation, structural centering of the condenser and steam flow through the turbine support members.

8 Claims, 3 Drawing Sheets

CONDENSER INTEGRATED TURBINE SUPPORT

BACKGROUND OF THE INVENTION

This invention was made in the course of and under a Contract N00024-79-C-4174 with the U. S. Navy. Rights to the U.S. Government in this invention are set forth in Patent Rights Clause 7-302.23(b) of the aforesaid Contract.

This invention is especially applicable to the design of support systems for marine power plants with specific application in the field of submarine vessels. The invention incorporates steam turbine condensers into the design of the support and uses the condensers as part of the supporting structure.

U.S. Pat. No. 2,531,178 represents one form of support system for a marine power plant available in the prior art. In that patent, assigned to the assignee of the present invention, a ship's service turbine-generator set is mounted on a support system which includes heavy base plates for the exciter and generator pedestal, the generator itself, the reduction gears and the turbine flex plates. In addition to these multiple base plates, the support system further includes fore to aft channel members and starboard to port channel members which when tied together form a massive rectangular subbase. The condenser is then hung from this subbase using plates which act in part as a flexure member. The condenser provides resistance to torsional deformation but does not support the subbase vertical load but rather adds to it. Moreover, the condenser and subbase as shown in the patent require redundant plate metal, in light of the present invention, thus adding unnecessarily to the payload of the ship.

If the patented design were to include two such marine power plants mounted side by side, the traditional plan of construction would require a ship centerline support in the form of a massive fore to aft box-beam supported on spaced apart "A" frame supports. The double-span construction introduced by the present invention obviates the heretofore required central box beam. Thus, weight savings are further provided by the combined turbine support system and condenser and by deleting the centerline box beam.

Since "A" frame members in the present invention do not carry vertical loads, further weight savings are achieved by diminished cross-sections. The present invention utilizes "A" frame members as a centering device for the condenser turbine support for accommodating rolling ship movement.

In addition, flex rails mounted on each side of the condenser turbine support permit thermal expansion of the support system while also accommodating hull deflections.

The present invention further addresses a marine power plant which also includes a propulsion turbine connected to a reduction or low speed gear and provides a mounting platform for these components comprised of plate metal box girders. Likewise, isolation of rotating component vibration is assured at the base of each component rather than between the overall base and the vessel hull.

OBJECTS OF THE INVENTION

It is an object of the invention to provide a weight reduced support system for a marine power plant.

It is another object of the invention to provide a support system for a marine power plant capable of withstanding vertical shock loads, hull deflections, and thermal expansions.

It is a further object of the invention to provide a support system for a marine power plant wherein reduced weight is accompanied by acceptable structure-borne noise vibration isolation.

The novel features believed characteristic of the present invention are set forth in the appended claims. The invention, itself, however, together with further objects and advantages thereof, may best be understood with reference to the following description taken in connection with the drawings.

SUMMARY OF THE INVENTION

A structural support system of reduced weight is proposed for a marine power plant which may include a steam driven propulsion turbine drivingly connected to a gear and propeller shaft and further including a ship service steam turbine generator set. The structural support system comprises a plurality of girders which span the entire width of the ship's hull and are spaced apart in the fore to aft direction. Plate members are attached to the top and side of the girders to form an enclosure which functions as a support and condenser for the aforementioned turbines. End caps including inlet and outlet headers are attached to selected girders and a drain well is attached at the bottom of the enclosure to further define the complete condenser. Cut-outs are provided in the top side of the plate to provide a discharge annulus for each steam turbine into the condenser. A unique "A" frame support limits movement of the condenser from side to side. Distributed isolation mounts are provided to minimize the passage of structure-borne noise from the rotating equipment into the condenser support structure.

DETAILED DESCRIPTION OF THE INVENTION

Figure 1:
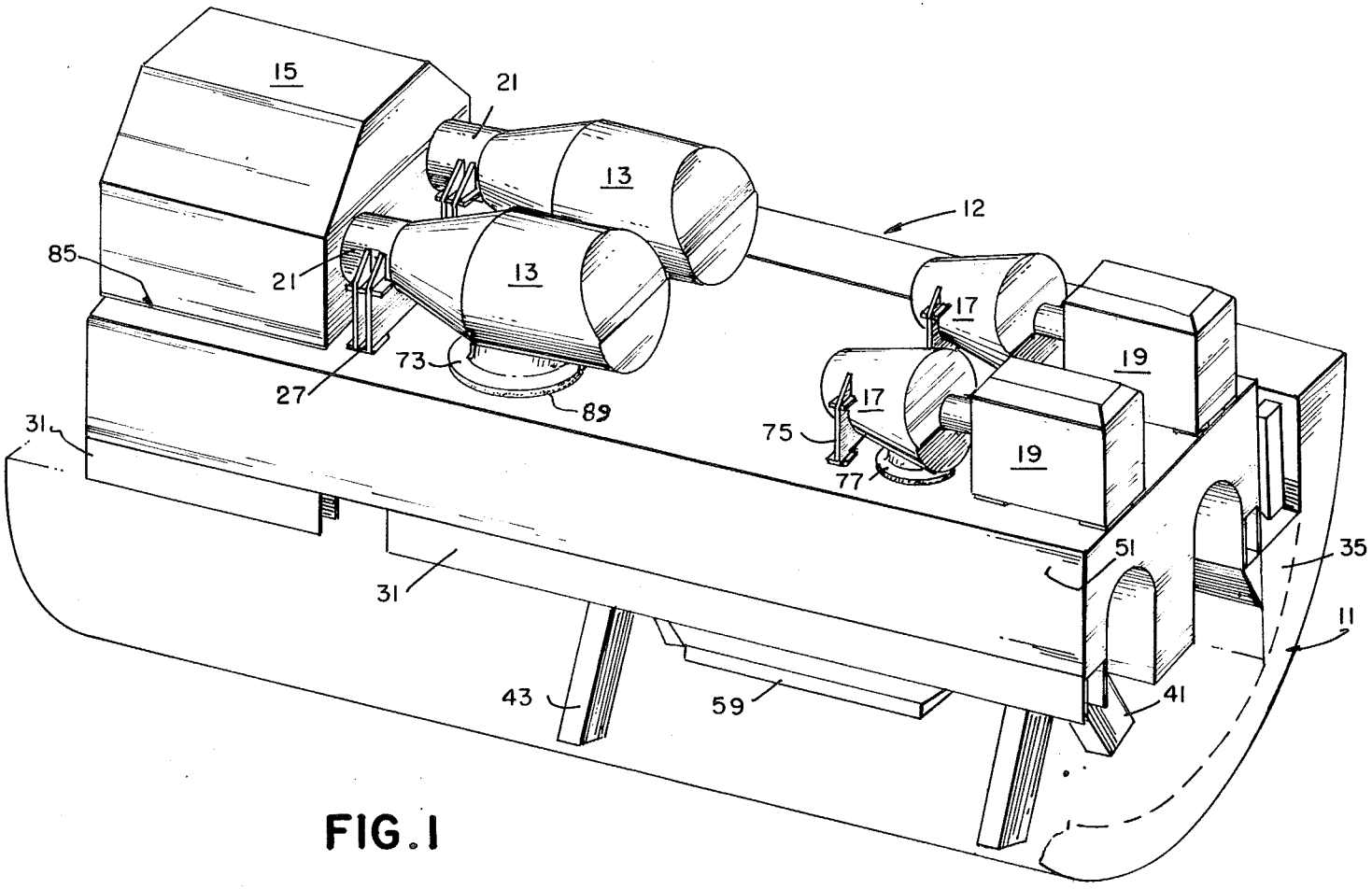
FIG. 1 is an isometric view of a power plant support in accordance with the present invention including an outline drawing of a section of a ship's hull.

FIG. 1 is an isometric view of a preferred embodiment of the present invention which shows in outline a portion of a ship's hull 11 and a combined condenser and turbine support system 12. A marine power plant may include at least one propulsion turbine 13 drivingly connected to a gear train (not shown) mounted in a gear housing 15. In the illustration shown, two propulsion steam turbines 13 are shown which provide separate power inputs into the gear casing. Each propulsion turbine may be connected to the gear casing by means of a flexible coupling 21.

In addition to the propulsion turbine and gear located at the aft end of the hull, the marine power plant may also include at the fore end of the hull at least one ship's service turbine generator set (SSTG) including a steam turbine 17 and an electrical generator 19. There are shown in this drawing two such SSTG sets. It should be clear to one skilled in the art that a marine power plant to which this invention may apply and be useful would only need to include one steam turbine requiring a condenser facility such as a power plant comprising solely either a steam turbine propulsion plant or a ship's service power plant or a combination of the two.

Figure 2:
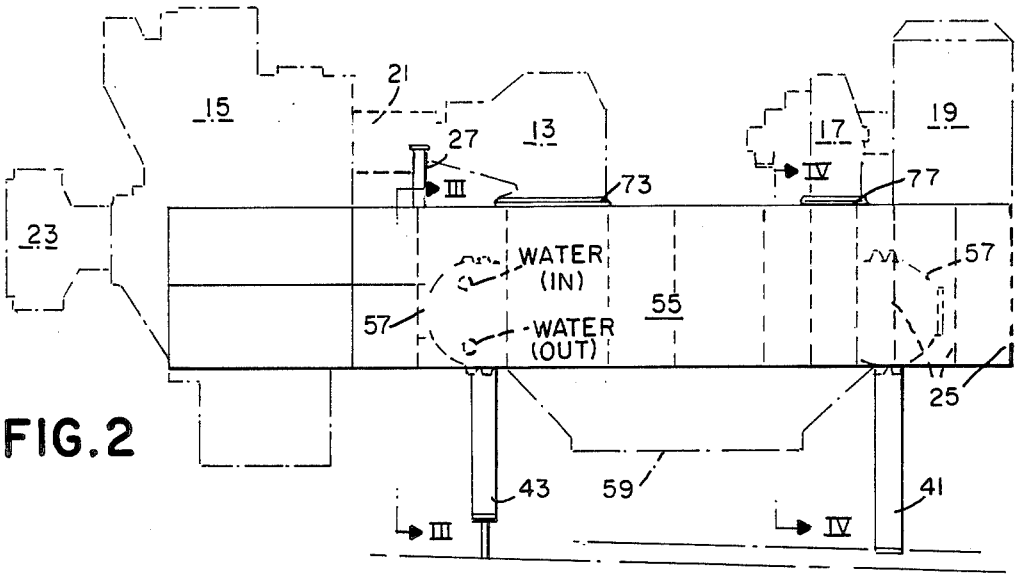
FIG. 2 is an elevation drawing of a power plant support in accordance with the present invention.

FIG. 2 shows an outline side elevation view of the various marine power plant elements and further includes a propulsion output shaft coupling 23. The support system for the marine power plant includes a plurality of girders 25 indicated in dotted lines extending completely across the ship's hull (port to starboard) and as shown and further explained in connection with FIGS. 3 and 4.

Figure 3:
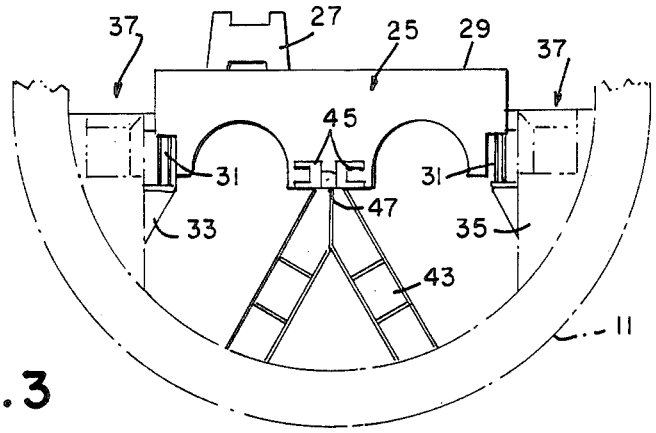
FIG. 3 is an end elevation view taken at III—III in the aft "A" frame support.
Figure 4:
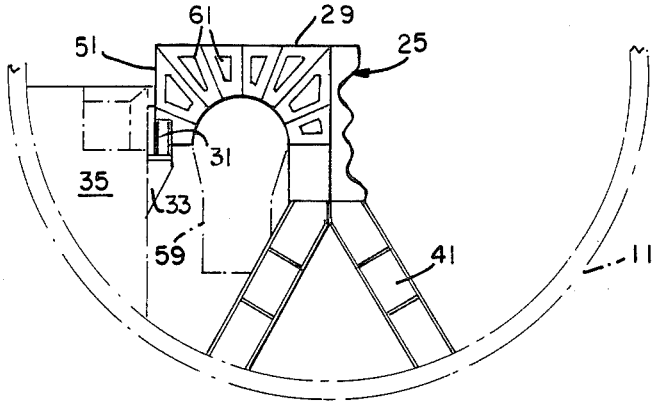
FIG. 4 is an end elevation view taken at IV—IV in the forward "A" frame support.

In FIG. 3, the drawing shows a cross-section elevation view taken at section III—III in FIG. 2. In FIG. 4, the drawing shows a cross-section elevation view taken at section IV—IV in FIG. 2. In FIG. 3, the main support element is the girder 25 which extends completely across the width of the ship, port to starboard. For purposes of orientation, a turbine support flex plate 27 for one of the propulsion turbines is shown mounted on the top side or deck 29 of the support system. This deck may be constructed of one half inch plate. The girder 25 itself may be reinforced three quarter inch steel and for end supports (end girders) as well as header supports is solid reinforced web plate. The girders may have 20 inch wide flanges with thicknesses on the order of two and one half inches. The girders are mounted on fore to aft side flex rails 31 which are mounted on angle support 33. The side flex rails 31 are slidable relative to the angle supports 33 to allow axial expansion of the support system although the aft ends of the flex rails may be fixed to restrict thermal axial expansion to one axial direction. This limits any adverse effect on system piping connections to the condenser. Typically, water inlet and outlet pipes shown in FIG. 2 are connected to inlet and outlet headers which are contained in condenser end cap 57. The support angle 33 may be grooved to accept the flex rails therein. The purpose of the flex rails is to accommodate some radial deflection of the hull, thermal expansion of the condenser and also to further accommodate vertical shock loadings. The angle supports or side pedestals are affixed to the side-hull tanks 35 located on the port and starboard hull sections. Excessive athwart ship's movement of the support systems due possibly to vertical shock loads relative to the hull is limited by means of side rail snubbers 37 built upon the hull tank 35.

In another aspect of this invention, there is mounted a fore "A" 41 frame and an aft "A" frame 43 within the hull of the ship. These "A" frames do not carry vertical load but rather contribute to athwart ship's stability on the support system. As is shown in FIG. 3, channel members 45 proximate to a girder and an "A" frame and fixed to the girder straddle a central beam or gib key 47 fixed to the "A" frame whereby athwart ship's motion is restrained while vertical and axial movement of the support system relative to the "A" frame is free and non-loading. It is clear that the girders 25 are supported only at each end with respect to vertical loads and that no vertical support is encountered at the centerline of the system.

The side walls 51 of the support system are one half inch plate and together with the top side or deck 29 constitute a portion of a condenser integral with the support system. The condenser further includes end caps 57 which accommodate inlet and outlet headers for passing water in parallel cooling pipes (not shown) but well known to persons of ordinary skill in the art. Normally the end caps adjacent aft "A" frame 43 will contain the inlet and outlet pipes whereas the other end cap adjacent the fore "A" frame will contain the end turns. Once again, this is to maintain the integrity of the piping connection at the fixed end of the condenser while allowing for thermal expansion at the untied end of the condenser support. A hot well 59 is also connected to the combined condenser and turbine support. In a preferred embodiment, there are two hot wells and two condensers built into the support system. Each of the girders 25 comprises two sections separated by a solid wall, the latter extending along the axial center line of the condenser. This allows one condenser to be completely removed from service when such action is desired or warranted. Therefore, each condenser includes a separate well, whereas there are four end caps, only two of which are shown in FIG. 2. Since it is now apparent that the structural support is also the condenser, note that the girders 25 lying within the interior portions of the condenser interior girders such as is shown in FIG. 4 will contain cutouts 61 which permit the axial flow of steam within the condenser.

Figure 5:
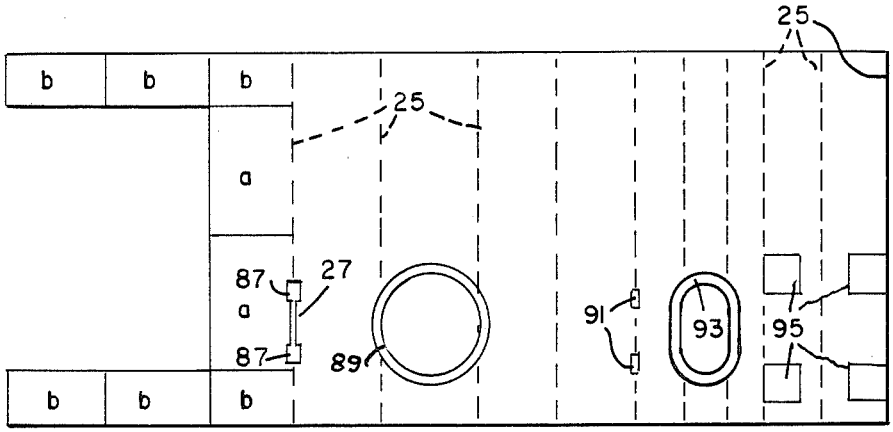
FIG. 5 is a plan view of the support system showing the position of the distributed isolation mounts.

FIG. 5 shows a plan view of the support system 12 for the purposes of describing the gear support structure and the location of noise vibration mounts. Only one side of the support system is shown in detail, it being understood that the mounting structure is identical for the other side. Moreover, the reader will appreciate that it may be useful to refer back to FIGS. 1 and 2 in conjunction with FIG. 5. Each propulsion turbine 13 is supported at its output end by a flex leg 27 and at its discharge end by an exhaust flange 73. The location of the flex leg 27 may coincide with the last or aft end girder support 25. Beyond this support, the remainder of the support system may be comprised of an arrangement of welded box girders "a" and "b" fastened together at the end of the previously described plate girder network with "a" box girders disposed along the ship's centerline and "b" box girders disposed at the support sides. The box girders may be fabricated two deep. That is, one on top of the other to achieve the desired depth of the mounting arrangement and likewise the box sections are also mounted on flex rails 31. Dotted lines in FIG. 5 indicate locations of underlying plate girders for the integral condenser turbine support. The gear housing 15 is mounted on box girder sections "a" and "b" and the low-speed gear wheel extends below the section between box girders "a" and "b".

Each ship's service turbine generator set includes turbine 17 supported on flex leg 75 and exhaust flange 77. Each generator 19 is mounted on the plate girder construction as,shown in FIG. 2.

In the prior art, it has been the standard practice to hard mount the rotating components to the subbase whereas noise isolation would be accomplished between the subbase and hull mounting. In the present invention, distributed isolation mounts are used between the various components and the condenser support system thus allowing the support system itself to be slidably mounted with respect to the hull tanks on flex rails 31. This allows for thermal expansion between the support system and hull support. In order to exemplify the distributed isolation mounts, gear isolation mounts 85 are shown in FIG. 1 between the gear casing 15 and the top side of the support system. The propulsion turbines are mounted on isolation mounts 87 under the flex legs 27 and isolation mounts 89 under the exhaust flange 73. This permits the selection of suitable and custom isolation mounts for each particular supported unit which therefore maximizes the noise reduction quality of the isolation mount while permitting an isolation mount having maximum rigidity. The ship's service turbine generators include isolation mounts 91 under flex legs 75, isolation mounts 93 under exhaust flange 77 and isolation mounts 95 under the four corners of each generator, respectively.

While there has been shown what is considered at present, to be the preferred embodiment of the invention, it is, of course, understood that various modifications may be made therein with respect to application and details obvious to other skilled in the art. It is intended to cover all such modifications as fall within the true scope and spirit of the invention.

What is claimed is:

1. A system for supporting a marine power plant in a ship's hull wherein the marine power plant includes at least one steam turbine, the support system comprising:

a plurality of power plant support girders mounted starboard to port and spaced apart in the fore to aft direction;

plate members attached to the girders to form an enclosure;

an opening in the topside plate of the enclosure for admitting steam into the enclosure from the steam turbine;

end caps attached at opposite ends to the enclosure;

a water inlet and a water outlet attached to at least one of the end caps; and, a drain well attached to the underside of the enclosure in fluid communication with the topside opening whereby the enclosure functions both as a power plant support and a steam condenser.

2. The support system recited in claim 1 wherein the girders contained within the enclosure are formed with cutouts to permit the axial flow of steam within the enclosure.

3. The support system recited in claim 1 further comprising:

at least one flex rail running fore to aft on each side of the support system and fixed with respect to the girders, said flex rails slidably mounted with respect to the ship's hull whereby axial thermal expansion of the support system is accommodated.

4. The support system recited in claim 1 further comprising:

at least one "A" frame support mounted in the ship's hull and adapted to slidably engage the support system for permitting axial and vertical movement of the enclosure while restraining-athwart ship's movement of the enclosure

5. The support system recited in claim 1 further comprising:

noise isolation mounts between the turbine and the enclosure whereby the transmission of noise vibration between the turbine and the ship's hull is minimized.

6. The support system recited in claim 1 wherein the steam turbine is drivingly connected to a gear supported in a gear casing and further including:

a pair of plate box sections' extending fore to aft and attached to the turbine-condenser support, said gear casing supported by and bridging between said pair of plate box sections and said gear lying between said pair of box sections.

7. A system for supporting a marine power plant in a ship's hull wherein the power plant includes a propulsion steam turbine drivingly connected to a gear and a ship's service steam turbine drivingly connected to an electrical generator, the support system comprising:

a plurality of power plant support girders running starboard to port and spaced apart in the fore to aft direction;

plate members attached to the girders to form an enclosure;

openings in the topside of the enclosure for admitting steam into the enclosure from the steam turbines;

a water inlet and a water outlet attached to the enclosure; and, a well attached to the underside of the enclosure in fluid communication with the topside openings, the propulsion steam turbine and the ship's service turbinegenerator set being supported on the topside plate and girders whereby the enclosure functions both as a support system and a steam condenser.

8. The system recited in claim 7 further comprising:

at least one plate box section extending starboard to port; and, at least one pair of spaced apart box sections extending in the fore and aft direction and supported on opposite sides of the hull and each fixed to one end of the starboard to port box section to form a gear support subassembly, the subassembly being fixed to and a part of the overall support system.

* * * * *